US005722813A

United States Patent [19]

Li et al.

[11] Patent Number: 5,722,813

[45] Date of Patent: Mar. 3, 1998

[54] SEGMENTED COMPOSITE COMPRESSOR DESWIRL

[75] Inventors: Pei-Ching Li, Gilbert; Bruce D. Reynolds, Phoenix; Theodore Westerman, Scottsdale, all of Ariz.

[73] Assignee: AlliedSignal Inc., Morris Township, N.J.

[21] Appl. No.: 739,478

[22] Filed: Oct. 28, 1996

[51] Int. Cl.[6] ..... F04D 29/44

[52] U.S. Cl. ..... 415/208.1; 415/209.2; 415/209.3

[58] Field of Search ..... 415/208.1, 208.2, 415/208.3, 209.1, 209.2, 209.3

[56] References Cited

U.S. PATENT DOCUMENTS

Re. 32,685 5/1988 Hess .

3,363,416 1/1968 Heybyrne et al. .

3,975,114 8/1976 Kalkbrenner .

*Primary Examiner*—John T. Kwon

*Attorney, Agent, or Firm*—James W. McFarland

[57] ABSTRACT

The present invention provides a self-sealing segmented deswirl molded from an organic matrix composite. Each deswirl segment is comprised of a length of outer shroud, an integral mounting flange extending radially outward from the shroud, and several integral deswirl vanes extending radially inward from the shroud. A means for sealing between segments is provided at the circumferential ends of the mounting flange. The sealing means includes an integral flexible sealing member extending from one end of the mounting flange, and a mating slot for sealingly receiving the sealing member at the other end of the mounting flange.

17 Claims, 3 Drawing Sheets

SEGMENTED COMPOSITE COMPRESSOR DESWIRL

TECHNICAL FIELD

This invention relates generally to deswirl vanes used in conjunction with centrifugal compressors. More particularly, the present invention relates to a self-sealing segmented compressor deswirl made of organic matrix composite material.

BACKGROUND OF THE INVENTION

Turbochargers are used in conjunction with internal combustion engines as a means for pre-compressing the combustion air entering the engine to improve engine operating efficiency. Deswirl vanes are often employed in the compressor portion of turbochargers to enhance compression and delivery of air. A typical turbocharger and engine arrangement is disclosed in U.S. Pat. No. 4,322,949, Hydraulic Assist Turbocharger System, issued to R. L. Cholvin et al. on Jul. 27, 1965.

A deswirl for use in a turbocharger typically comprises an annular outer shroud and a plurality of turning vanes connected to the shroud. Such a deswirl set of vanes may further include an inner shroud for reducing leakage past the vane tips. However, deswirls with inner shrouds have a disadvantage that the vane length cannot be changed once the deswirl is completed. Leaving off the inner shroud advantageously enables suppliers to stock just one size deswirl, and thereafter machine the vanes to length per customer specifications, saving on inventory costs and reducing customer delay. Because of these advantages, deswirls without an inner shroud are generally preferable.

Most often the deswirl is a welded arrangement, whereby the vanes are separately fabricated and then welded into preformed slots in the shroud. The vanes and shroud ring are usually steel, but can be any suitable metal that is weldable and possesses adequate mechanical properties. A disadvantage to this type of construction is the cost associated with welding the vanes to the shroud. In addition, the welding tends to induce warping of the shroud ring which causes misalignment of the vanes.

Alternatively, the deswirl may be cast from a material such as aluminum, which reduces the problems of warping and vane misalignment caused by welding. Casting has the additional advantage of eliminating the fabrication and quality control costs associated with welding. However, these cost savings can be more than offset by the investment in tooling and in engineering required to achieve adequate dimensional control of a large aluminum castings of this type. Moreover, the size of the deswirl ring, whether of a cast or welded configuration, adds significantly to the manufacturing expense. For example, a large portion of the cost and the time involved in machining the vanes to length can be attributed to the large size and shape of the deswirl.

One approach to a solution has been to configure the deswirl as multiple segments rather than as a complete ring. The more manageable size and shape of the segments results in substantially reduced tooling costs, and improved dimensional accuracy. Also, expense and time associated with machining operations, such as custom machining the vanes to length, and facing off the mounting flange, are reduced. However, breaking up the deswirl into segments introduces multiple paths for compressed air contained within the flow path to escape. More specifically, a leak path is defined at the ends of every segment where the mounting flanges of adjacent segments abut one another. Attempts to control leakage by minimizing this inter-segment gap are largely unsatisfactory, due in part to the dimensional tolerances involved in both the deswirl segments and mating turbocharger flanges, and due in part to variations in gap width caused by differential thermal growth. Thus, various types of separate sealing devices are typically employed between segment ends, thereby incurring the additional cost of the parts themselves and the costs associated with periodic inspection and replacement of deteriorated seals.

Accordingly, a need exists for an inexpensive and dimensionally accurate segmented deswirl that can be produced without welding, and that provides adequate segment-to-segment sealing without the need for separate additional sealing devices.

SUMMARY OF THE INVENTION

In view of the above, it is an object for this invention to provide an inexpensive and dimensionally accurate segmented deswirl that can be produced without welding. It is another object for this invention to provide a segmented deswirl with adequate segment-to-segment sealing without the need for separate additional sealing devices.

The present invention achieves these objects by providing a self-sealing segmented deswirl molded from an organic matrix composite. Each deswirl segment is comprised of a length of outer shroud, an integral mounting flange extending radially outward from the shroud, and several integral deswirl vanes extending radially inward from the shroud. A means for sealing between segments is provided at the circumferential ends of the mounting flange. The sealing means includes an integral flexible sealing member extending from one end of the mounting flange, and a mating slot for sealingly receiving the sealing member at the other end of the mounting flange.

These and other objects, features and advantages of the present invention are specifically set forth in or will become apparent from the following detailed description of a preferred embodiment of the invention when read in conjunction with the accompanying drawings.

DESCRIPTION OF THE PREFERRED EMBODIMENT

Figure 1:
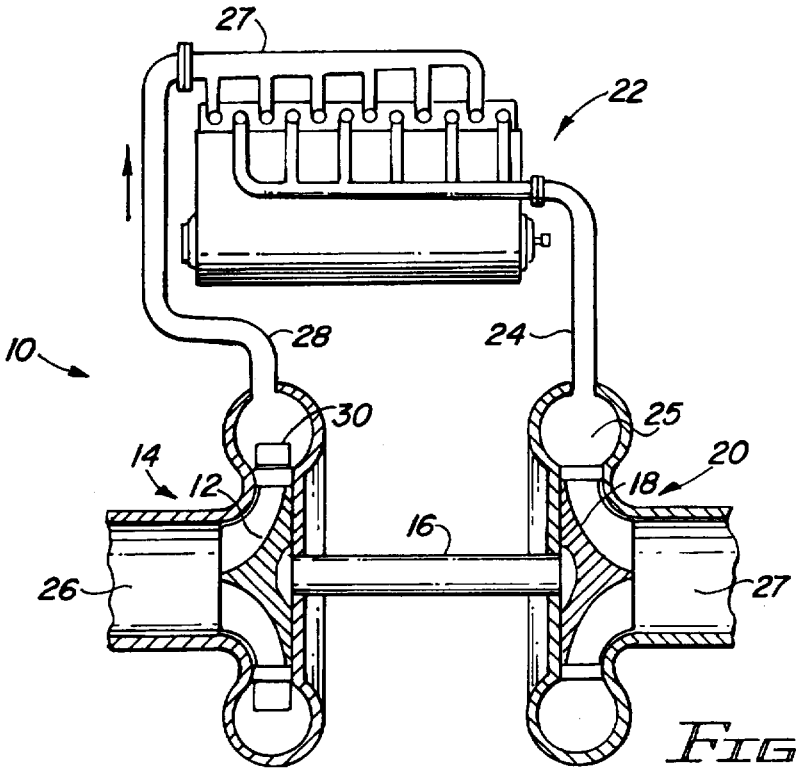
FIG. 1 depicts a partially schematic, partially elevational cross-sectional view of a turbocharger connected to an internal combustion engine.

Depicted in FIG. 1 is a system generally representative of that disclosed in Cholvin, wherein a turbocharger 10 is connected to an internal combustion engine 22. The turbocharger 10 includes a centrifugal compressor wheel 12 within a compressor housing 14 interconnected by a rotatably mounted shaft 16 to a centrifugal turbine wheel 18 located within a turbine housing 20. Turbine housing 20 includes an engine exhaust gas inlet 25 and a turbine discharge 27. High pressure exhaust gas from engine 22 is ported through an exhaust duct 24 to the inlet 25, causing the centrifugal turbine 18 to rotate. The rotating turbine wheel rotatably drives the shaft 16 and the compressor wheel 12, whereby the compressor wheel 12 draws in and compresses ambient air from the compressor inlet 26 This compressed ambient air comprises charge or boost air for the engine and is supplied to the intake manifold 27 of the engine 22 via a charge air conduit 28.

Figure 2:
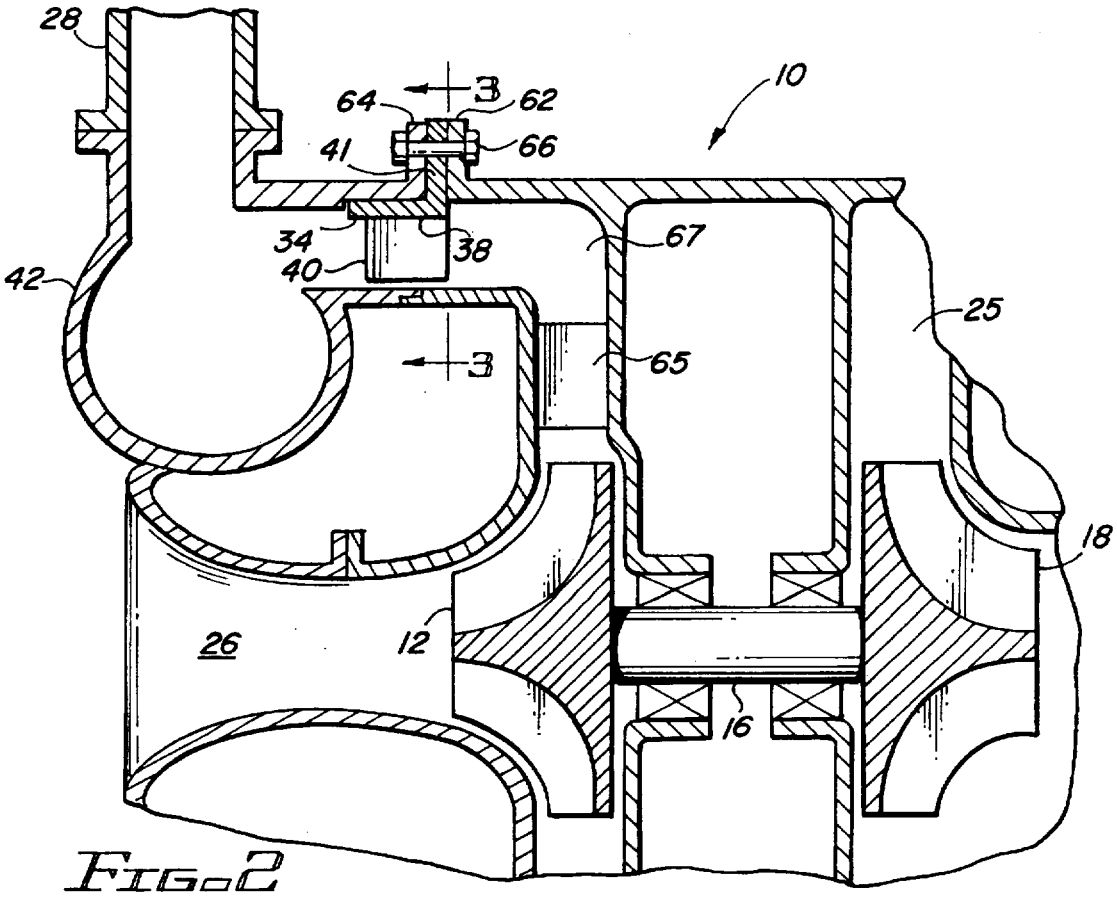
FIG. 2 depicts a cross sectional view of the compressor region of a turbocharger containing a deswirl of the type contemplated by the present invention.
Figure 3:
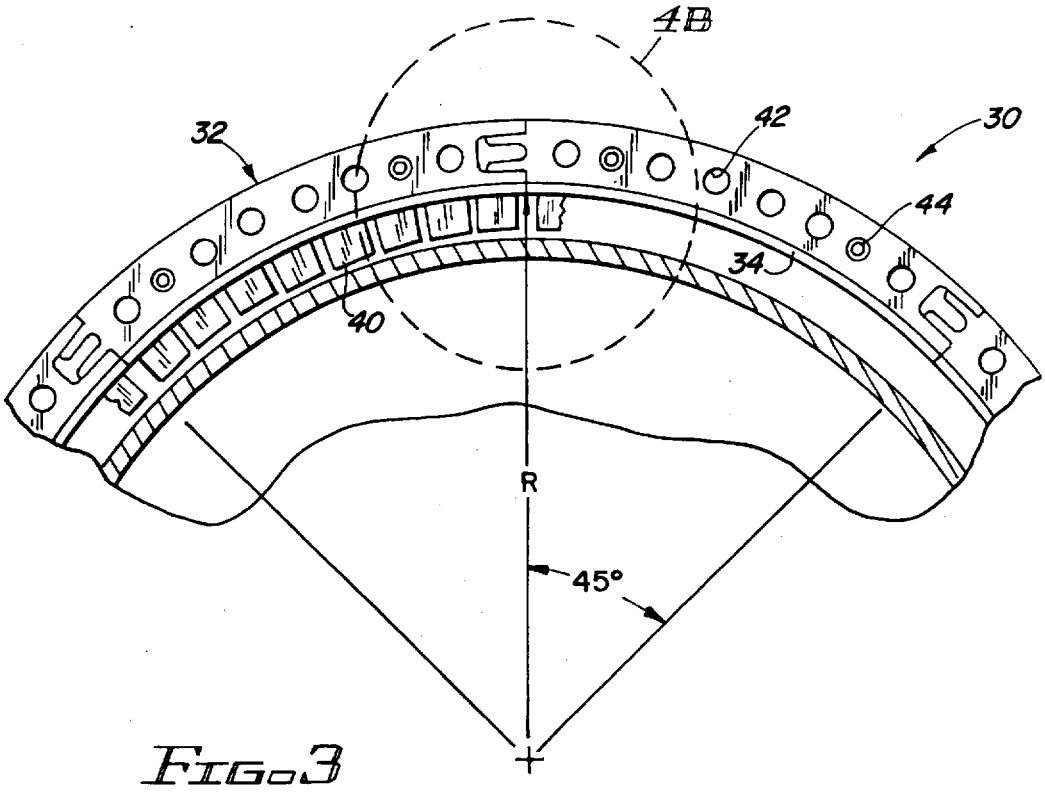
FIG. 3 depicts a transverse sectional view taken along line 3—3 of FIG. 2.

Referring now to FIGS. 2 and 3, the turbocharger 10 includes an annular shaped compressor discharge duct 67 connecting the compressor 12 to a toroidal shaped collector 42. Within discharge duct 67 is a diffuser 65 positioned just downstream of the compressor 12, and a deswirl 30 positioned just upstream of the collector 42. The diffuser 65 and deswirl 30 generally provide for efficient transfer of the air from the turbocharger to the charge air conduit 28. The diffuser 65 functions primarily to diffuse the compressor discharge air so as to convert velocity into pressure head. The deswirl functions primarily to reduce the rotational velocity of the discharge airflow in duct 67 to an optimal level for most efficiently entering the collector 42.

The segmented composite deswirl 30 of the subject invention has an annular configuration, and is comprised of a plurality of separate equally sized deswirl segments 32. In the preferred embodiment, the deswirl 30 consists of eight segments 32, each segment circumferentially spanning a 45 degree arc. The deswirl segments 32 are made of injection molded Polyetheretherketone plastic, commonly known as PEEK. The PEEK is an organic matrix composite containing approximately 30% carbon fiber filler by volume. Injection molded PEEK has the advantages of low cost and improved dimensional control due to reduced shrinkage compared to cast aluminum. Also, plastics such as PEEK are many times more flexible than metal, enabling the incorporation in the deswirl segments of an integral sealing feature, as described in detail below. Alternatively, the segments may be of any similar moldable material having adequate mechanical properties.

Figure 4A:
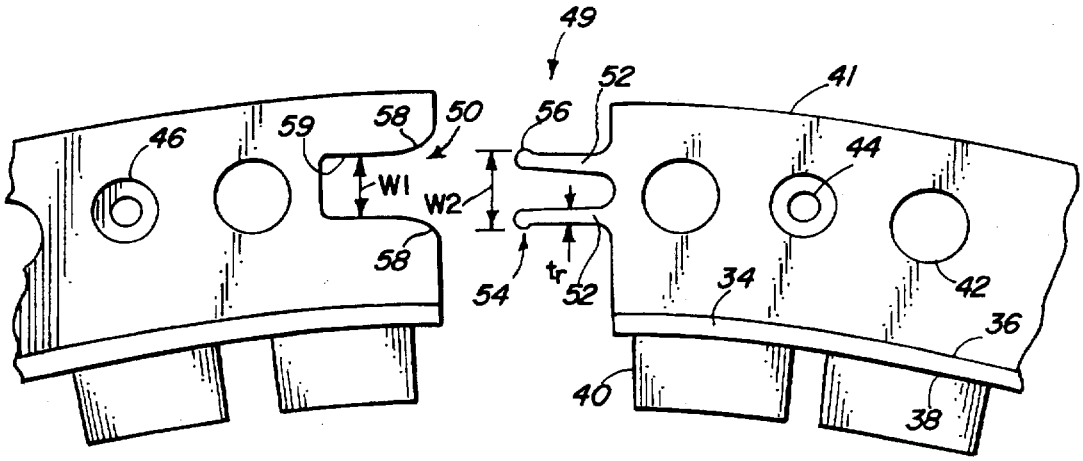
FIG. 4A depicts an exploded view of adjacent deswirl segment ends of the type contemplated by the present invention.

Each deswirl segment 32 includes an outer shroud 34 having a circular arc profile with radius of curvature equal to the radius R of the deswirl as indicated in FIG. 3. Referring to FIGS. 4A through 5, shroud 34 defines an outer surface 36 and inner surface 38, the inner surface 38 defining a portion of the outer flowpath of the compressor discharge duct 67. Several airfoil shaped turning vanes 40 extend radially inward from the shroud inner surface 38 and project across the duct 67. The vanes 40 are oriented at an angle A to the axial direction as shown in FIG. 5. Preferably the angle A is between about 40 and 50 degrees. The flowpath surfaces of the vanes 40 as well as the inner surface 38 of shroud 34 are completely defined by the injection molding process, requiring no additional machining aside from minimal clean-up. An acceptable as-molded finish is achieved on these surfaces either by polishing the mold, or by conventional tumbling techniques.

Extending radially outward from one end of the outer shroud 34 is a mounting flange 41. When assembled in the turbocharger, flange 41 becomes axially clamped between the case flanges 62 and 64 of the turbocharger upon tightening case bolts 66. As a consequence of the segmented design, any significant variation in the thickness of flange 41 between segments can result in some segments being more tightly clamped than others, thereby promoting leakage. The thickness and flatness of mounting flange 41 must therefore be accurately controlled to minimize uneven clamping and the resulting leakage. Thus, unlike the vane surfaces and the inner surface of the shroud, the faces of the flange 41 are usually machined flat after injection molding to ensure sufficient dimensional consistency between segments.

The mounting flange 41 also includes case bolt holes 42 and mounting screw holes 44. Each deswirl segment contains six case bolt holes 42 for allowing turbocharger case bolts 66 to pass through the flange 41. The holes 42 are large enough to provide for clearance around each case bolt 66 when the segment is properly positioned. Each segment 32 includes two mounting screw holes 44. The holes 44 provide means for mounting the deswirl segments to the turbocharger case flanges, whereby two mounting screws (not shown) are passed through holes 44 in flange 41, and screwed into threaded holes (not shown) in the mating turbocharger flange 62. Holes 44 also provide a means for accurately positioning the individual segments with respect to each other and with respect to the duct 67. In that regard the size and the location of holes 44 must be carefully controlled. Each screw hole 44 also has a countersink 46 for accepting the head of the mounting screw. The depth of the countersink 46 must be sufficient to ensure that when the mounting screw is tightened against flange 41, the head of the screw lies at or below flush with the face of the flange.

Figure 4B:
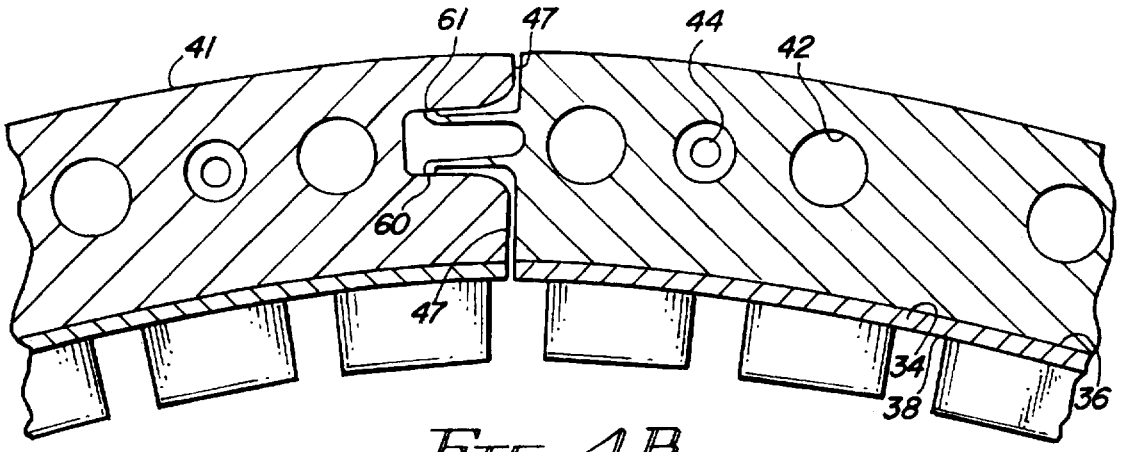
FIG. 4B depicts an enlarged fragmentary sectional view of an encircled portion of FIG. 3.
Figure 5:
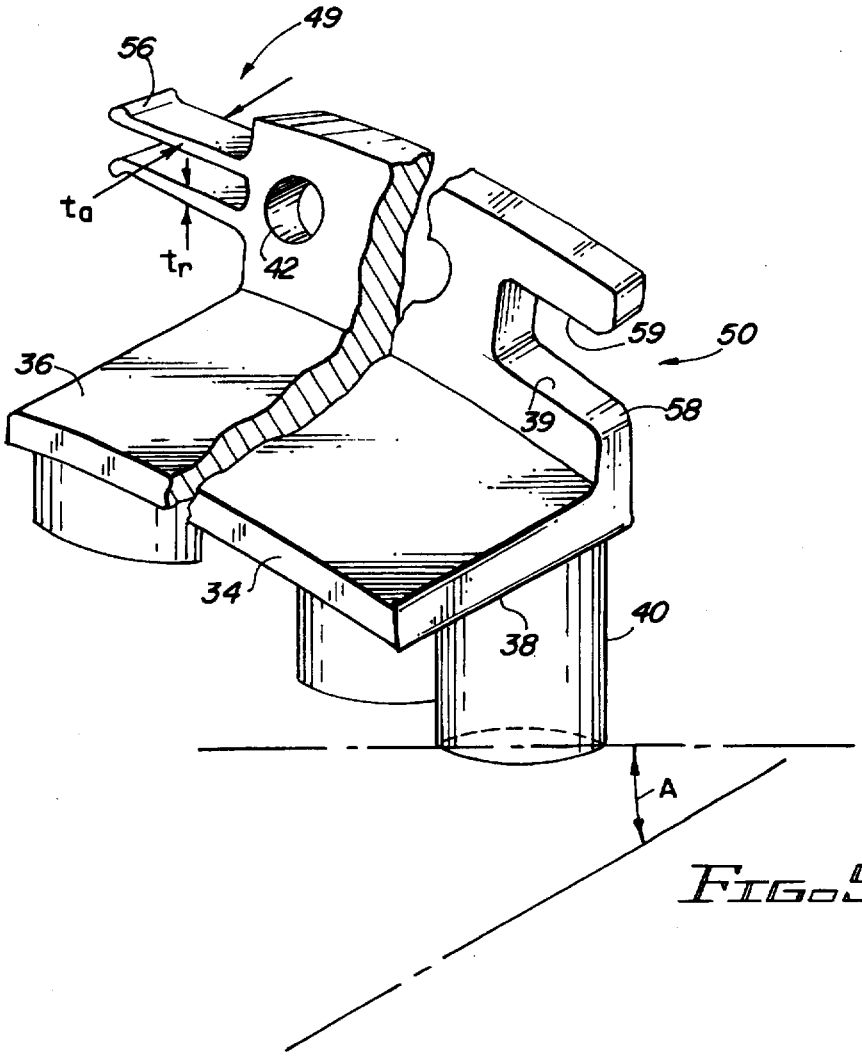
FIG. 5 depicts a perspective view of a deswirl segment of the type contemplated by the present invention.

Each segment includes sealing means to prevent leakage between abutting ends of adjacent segments through the leak path 47 indicated in FIG. 4B. The sealing means includes an integral flexible sealing member 49 extending in the circumferential direction from one end of the mounting flange 41, and a mating slot 50 for sealingly receiving the sealing member at the other end of the mounting flange. Sealing member 49 is radially located approximately in the middle of the end of flange 41, and comprises at least one, but preferably two, flexible prongs 52. Prongs 52 are roughly parallel, and spaced radially apart so as to be generally in alignment with the radially facing surfaces 59 of the mating slot 50 of an adjacent segment. The end of each prong 52 has a rounded protrusion 54 defining a sealing surface 56 for contacting the surfaces 59 of slot 50. The axial facing edges of the prongs 52 are aligned with the faces of the flange 41 forming a continuous surface, whereby the prongs and the flange 41 have the same width. The prongs 52 are of rectangular cross section, and substantially thinner radially than axially so as to impart radial flexibility to the prongs. More particularly, the radial thickness $t_r$, indicated in FIGS. 4A and 5, is preferably no less than ⅙ and no greater than ⅓ the axial thickness $t_a$ of the prongs 52 and flange 41.

At the opposite end of the deswirl segment, flange 41 defines a slot 50 for receiving the prongs 52 of an adjacent segment. Referring in particular to FIG. 4B, the slot 50 is long enough to provide clearance between the ends of prongs 52 and the end of the slot 50 when the ends of the flanges 41 of two adjacent segments are abutting one another. The radial width $W_1$ of the slot 50 is selected to be slightly less than the radial width $W_2$ across sealing surfaces 56 of prongs 52, thereby creating a radial interference between the sealing member 49 and slot 50. Thus, in order to insert the prongs 52 into the slot 50, the ends of the prongs must first be slightly squeezed together. In the case of a sealing member comprising only one prong 52, the prong would simply be deflected for insertion into slot 50. Slot 50 further includes heavily rounded corners defining a tapered entry portion 58 for receiving the prongs 52. The tapered entry 58 facilitates assembly by causing the prongs to be squeezed together as they are forced through the entry 58 and into the slot 50. The relatively small radial thickness of the prongs combined with the inherent flexibility of the PEEK material imparts enough bending flexibility to the prongs so that the prongs may be inserted into the slot by hand.

Once assembled, the interfering relationship between the prongs 52 and the slot 50 causes sealing surfaces 56 to be spring loaded against the inner surfaces 59 of slot 50, thereby creating two sealing interfaces 60 and 61. The sealing interfaces 60 and 61 block high pressure air from leaking out of the turbocharger case through the leak paths 47. It will be apparent that the pressure load on the radially innermost prong acts against the spring loading, tending to unseat the sealing surface 56 at sealing interface 60. On the other hand, the pressure loading on the outer prong adds to the spring force keeping sealing surface 56 seated against the slot. Thus, if sealing member 49 comprises only one prong 52, maximum sealing benefit would be obtained by sealing at interface 61 as does the outer prong in the preferred embodiment.

Improved material properties can be obtained by annealing the PEEK after the injection molding process. The deswirl segments are preferably annealed according to the following specification:

1. Place the part in an oven preheated to 350 F. for one hour.
2. Increase the temperature to 400 F. for one hour.
3. Increase the temperature to 450 F. for four hours.
4. Reduce the temperature to 400 F. for one hour.
5. Reduce the temperature to 350 F. for one hour.
6. Turn the oven off and slow cool to room temperature.

Although the foregoing description of the invention refers to a deswirl in the compressor portion of a turbocharger, the advantages provided by a deswirl as contemplated by the present invention apply in addition to deswirls for superchargers, and more generally to deswirls for centrifugal compressors used in turbomachinery.

Various modifications and alterations of the above described invention will be apparent to those skilled in the art. Accordingly, the foregoing detailed description of the preferred embodiment of the invention should be considered exemplary in nature and not as limiting to the scope and spirit of the invention as set forth in the following claims.

What is claimed is:

1. A deswirl arrangement for the compressor of a turbocharger or supercharger comprising:

a plurality of deswirl segments made of injection molded organic matrix composite material, each deswirl segment comprising:

an outer arcuate shroud segment having an inner surface and an outer surface;

a plurality of airfoil shaped vanes extending radially inward from said inner surface of said outer shroud;

a mounting flange extending radially outward from said outer shroud outer surface, said mounting flange defining two axially facing surfaces and extending circumferentially the entire length of said outer shroud, said mounting flange and said outer shroud together defining a circumferentially-facing edge at each end of said deswirl segment for abutting a corresponding circumferentially-facing edge of an adjacent deswirl segment;

an integral flexible sealing member at one end of said mounting flange projecting circumferentially from said circumferentially-facing edge; and the other end of said mounting flange defining a mating slot extending from said respective circumferentially-facing edge for sealingly receiving the flexible sealing member of an adjacent deswirl segment.

2. The deswirl arrangement of claim 1, wherein said flexible sealing member comprises at least one radially flexible prong circumferentially extending from said end of said mounting flange and terminating at a free end, said prong defining a sealing surface proximate said free end for sealingly contacting a radially facing surface of said mating slot, said sealing surface located so as to radially interfere with said mating slot surface thereby causing said sealing surface to be spring-loaded against said mating slot surface once assembled.

3. The deswirl arrangement of claim 2, wherein said flexible prong is of rectangular cross section having two radially facing surfaces defining a radial width and two axially facing surfaces defining an axial width, and wherein said sealing surface comprises a radially protruding bump on one of said radially facing surfaces of said prong.

4. The deswirl arrangement of claim 3, wherein said axially facing surfaces of said prong are coplanar with the respective axially facing surfaces of said mounting flange such that said prong and said mounting flange have the same axial thickness.

5. The deswirl arrangement of claim 3, wherein said radial thickness of said prong is no less than one sixth and no greater than one third of said axial thickness of said prong.

6. The deswirl arrangement of claim 5, wherein said sealing member comprises two prongs.

7. The deswirl arrangement of claim 1, wherein said slot in said mounting flange includes a tapered entry portion to facilitate insertion of said sealing member into said slot.

8. The deswirl arrangement of claim 1, wherein said mounting flange includes at least two countersunk screw holes adapted to receive screws for mounting and positioning said deswirl segments to said turbocharger.

9. A centrifugal compressor comprising:

a housing defining a fluid inlet and an annularly shaped discharge passage;

a centrifugal impeller mounted for rotation in the housing; and a deswirl arrangement for deswirling a compressed discharge fluid flow in said discharge passage, said deswirl arrangement comprising a plurality of deswirl segments made of injection molded organic matrix composite material, each deswirl segment further comprising:

an outer arcuate shroud segment having an inner surface and an outer surface;

a plurality of airfoil shaped vanes extending radially inward from said inner surface of said outer shroud;

a mounting flange extending radially outward from said outer shroud outer surface, said mounting flange defining two axially facing surfaces and extending circumferentiaily the entire length of said outer shroud, said mounting flange and said outer shroud together defining a circumferentially-facing edge at each end of said deswirl segment for abutting a corresponding circumferentially-facing edge of an adjacent deswirl segment;

an integral flexible sealing member at one end of said mounting flange projecting circumferentially from said circumferentially-facing edge; and the other end of said mounting flange defining a mating slot extending from said respective circumferentially-facing edge for sealingly receiving the flexible sealing member of an adjacent deswirl segment.

10. The centrifugal compressor of claim 9, wherein said flexible sealing member comprises at least one radially flexible prong circumferentially extending from said end of said mounting flange and terminating at a free end, said prong defining a sealing surface proximate said free end for sealingly contacting a radially facing surface of said mating slot, said sealing surface located so as to radially interfere with said mating slot surface thereby causing said sealing surface to be spring-loaded against said mating slot surface once assembled.

11. The centrifugal compressor of claim 10, wherein said flexible prong is of rectangular cross section having two radially facing surfaces defining a radial width and two axially facing surfaces defining an axial width, and wherein said prong sealing surface comprises a radially protruding bump on one of said radially facing surfaces.

12. A turbocharger comprising:

a compressor housing defining a fluid inlet, and an annularly shaped compressor discharge passage;

a centrifugal compressor mounted for rotation in the compressor housing;

a turbine housing defining an engine exhaust gas inlet and a turbine exhaust duct;

a turbine mounted for rotation in said turbine housing;

a shaft interconnecting said centrifugal compressor and centrifugal turbine; and a deswirl arrangement for deswirling a compressed discharge fluid flow in said compressor discharge passage, said a deswirl arrangement comprising a plurality of deswirl segments made of injection molded organic matrix composite material, each deswirl segment further comprising:

an outer arcuate shroud segment having an inner surface and an outer surface;

a plurality of airfoil shaped vanes extending radially inward from said inner surface of said outer shroud;

a mounting flange extending radially outward from said outer shroud outer surface, said mounting flange defining two axially facing surfaces and extending circumferentially the entire length of said outer shroud, said mounting flange and said outer shroud together defining a circumferentially-facing edge at each end of said deswirl segment for abutting a corresponding circumferentially-facing edge of an adjacent deswirl segment;

an integral flexible sealing member at one end of said mounting flange projecting circumferentially from said circumferentially-facing edge; and the other end of said mounting flange defining a mating slot extending from said respective circumferentially-facing edge for sealingly receiving the flexible sealing member of an adjacent deswirl segment.

13. The turbocharger of claim 12, wherein said flexible sealing member comprises at least one radially flexible prong circumferentially extending from said end of said mounting flange and terminating at a free end, said prong defining a sealing surface proximate said free end for sealingly contacting a radially facing surface of said mating slot, said sealing surface located so as to radially interfere with said mating slot surface thereby causing said sealing surface to be spring-loaded against said mating slot surface once assembled.

14. The turbocharger of claim 13, wherein said flexible prong is of rectangular cross section having two radially facing surfaces defining a radial width and two axially facing surfaces defining an axial width, said axially facing surfaces of said prong being coplanar with the respective axially facing surfaces of said mounting flange such that said prong and said mounting flange have the same axial thickness.

15. The turbocharger of claim 14, wherein said sealing surface comprises a radially protruding bump on one of said radially facing surfaces of said prong.

16. The turbocharger of claim 15, wherein said sealing member comprises two prongs.

17. The turbocharger of claim 12, wherein said mounting flange includes at least two countersunk screw holes adapted to receive screws for mounting and positioning said deswirl segments to said turbocharger.

* * * * *